US010278544B1

(12) United States Patent
Kiddell et al.

(10) Patent No.: US 10,278,544 B1
(45) Date of Patent: May 7, 2019

(54) SHOWER MAT WITH AUXILIARY SHOWER SPRAY HEAD

(71) Applicants: William Lee Kiddell, Sunrise, FL (US); Patrick John Zone, Sunrise, FL (US)

(72) Inventors: William Lee Kiddell, Sunrise, FL (US); Patrick John Zone, Sunrise, FL (US)

( * ) Notice: Subject to any disclaimer, the term of this patent is extended or adjusted under 35 U.S.C. 154(b) by 0 days.

(21) Appl. No.: 16/183,362

(22) Filed: Nov. 7, 2018

Related U.S. Application Data

(60) Provisional application No. 62/765,737, filed on Sep. 12, 2018.

(51) Int. Cl.
*A47K 3/40* (2006.01)
*A47K 3/28* (2006.01)

(52) U.S. Cl.
CPC ..... *A47K 3/281* (2013.01); *A47K 3/40* (2013.01)

(58) Field of Classification Search
CPC ..... A47K 3/281
USPC ..... 4/569–614
See application file for complete search history.

(56) References Cited

U.S. PATENT DOCUMENTS 439,793 A * 11/1890 Taylor ..... E03C 1/0408 4/601
585,439 A * 6/1897 Hooper ..... E03C 1/0408 4/601
4,397,050 A * 8/1983 Davis ..... E03C 1/06 239/381
5,154,671 A * 10/1992 Smollar ..... A63G 21/18 472/117
5,401,214 A * 3/1995 Smollar ..... A63G 21/18 446/489
2006/0242758 A1* 11/2006 Hall ..... A47K 3/28 4/601
2007/0264075 A1* 11/2007 Panasci ..... A46B 5/002 401/289
2009/0000022 A1* 1/2009 Phipps ..... E03C 1/0408 4/601

* cited by examiner

*Primary Examiner* — Lori Baker
(74) *Attorney, Agent, or Firm* — Dunlap Bennett & Ludwig PLLC; Brendan E. Squire

(57) ABSTRACT

A shower mat is configured to carry an auxiliary shower spray head to deliver a spray vertically upwards to allow the user to clean their lower body and extremities. The mat may include a plurality of layers with the auxiliary shower spray head carried between the plurality of layers. Tubing interconnects the auxiliary spray head to a diverter valve that is connected to a stem of a shower enclosure.

11 Claims, 3 Drawing Sheets

FIG. 1
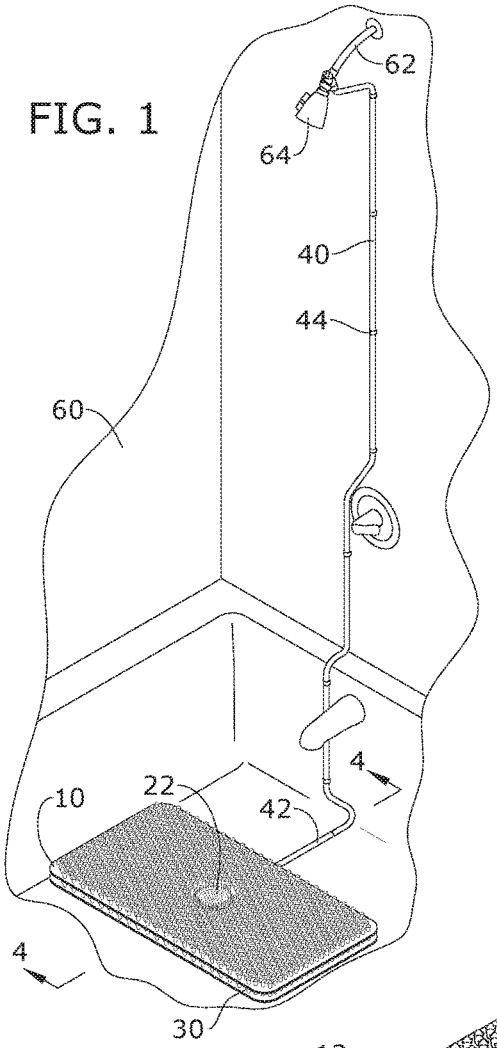
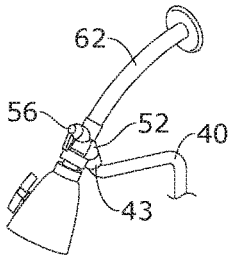
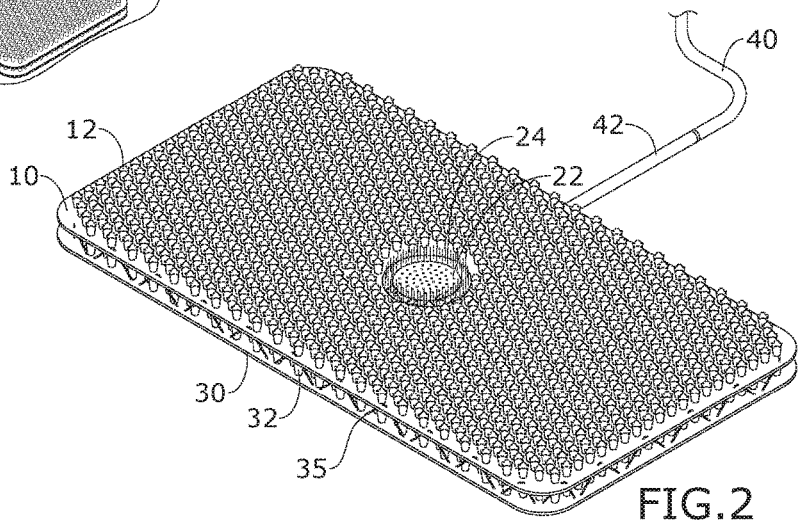
FIG.2

SHOWER MAT WITH AUXILIARY SHOWER SPRAY HEAD

CROSS-REFERENCE TO RELATED APPLICATION

This application claims the benefit of priority of U.S. provisional application No. 62/765,737, filed Sep. 12, 2018, the contents of which are herein incorporated by reference.

BACKGROUND OF THE INVENTION

The present invention relates to showers for bathing, and more particularly to shower mats and auxiliary shower spray heads.

For many individuals, particularly the elderly, disabled, or others with limited flexibility, it can be difficult to appropriately clean their feet, legs, and lower body. While the stream of water from a conventional wall mounted shower head may be utilized for bathing the lower extremities for more agile individuals, the inability of an individual to safely reach their legs and feet presents problems for others.

Auxiliary hose mounted shower heads are known and can assist users with directing the shower spray. However, the user must hold the shower head to direct the spray to their lower extremities. This may make it difficult for the user to apply a cleaning agent, such as soap, while they hold the auxiliary shower head. For those that need to stabilize themselves while showering, this can present an unnecessary safety risk.

As can be seen, there is a need for an apparatus and method for bathing assistance for the lower body and extremities.

SUMMARY OF THE INVENTION

In one aspect of the present invention a shower mat with an auxiliary shower spray head is disclosed. The shower mat includes a first mat formed of a resilient material having a first cutout defined in the surface thereof. A second mat is also formed of a resilient material having a second cutout defined in a surface thereof. An auxiliary shower spray head has a body, an inlet adapted to receive a source of pressurized water, and a spray nozzle face in communication with the inlet. The body is adapted to be received in the second cutout and the spray nozzle face is adapted to be received in the first cutout such that the spray nozzle face is oriented to direct a spray of water vertically upwardly.

In some embodiments, the auxiliary shower spray head may also include a plurality of resilient bristles defined in a spaced apart relation about a peripheral edge of the spray nozzle face. A plurality of resilient bristles may also be defined in a spaced apart relation about a top surface of the first mat. Likewise, a second plurality of resilient bristles may be defined in a spaced apart relation about a top surface of the second mat.

The shower mat may also include a diverter valve that is connectable between a stem of a shower enclosure and a primary shower head of the shower enclosure. The diverter valve is operable between a first position directing a flow of pressurized water to the primary shower head and a second position directing the flow of pressurized water to the auxiliary shower spray head. In some embodiments, the diverter valve directs a proportion of the flow between the primary shower head and the auxiliary shower when operated at an intermediate position between the first position and the second position.

The shower mat may also include an elongate tube having a first end and a second end, wherein the first end is adapted to connect to the diverter valve and the second end is adapted to connect to the inlet of the auxiliary shower spray head. A tubing connector segment may be interposed between the inlet and the second end of the tubing. One or more clips may be included to secure the tubing to the shower enclosure.

In certain embodiments a stitch may join the first mat to the second mat. The stitch may extend around an outer periphery of the first mat and the second mat.

These and other features, aspects and advantages of the present invention will become better understood with reference to the following drawings, description and claims.

BRIEF DESCRIPTION OF THE DRAWINGS

FIG. 1 is a perspective view of an embodiment of SHOWER MAT WITH AUXILIARY SHOWER SPRAY HEAD, shown in use;

FIG. 2 is a perspective view of the shower mat with auxiliary shower spray head, shown in an exemplary assembly;

DETAILED DESCRIPTION OF THE INVENTION

Figure 3:
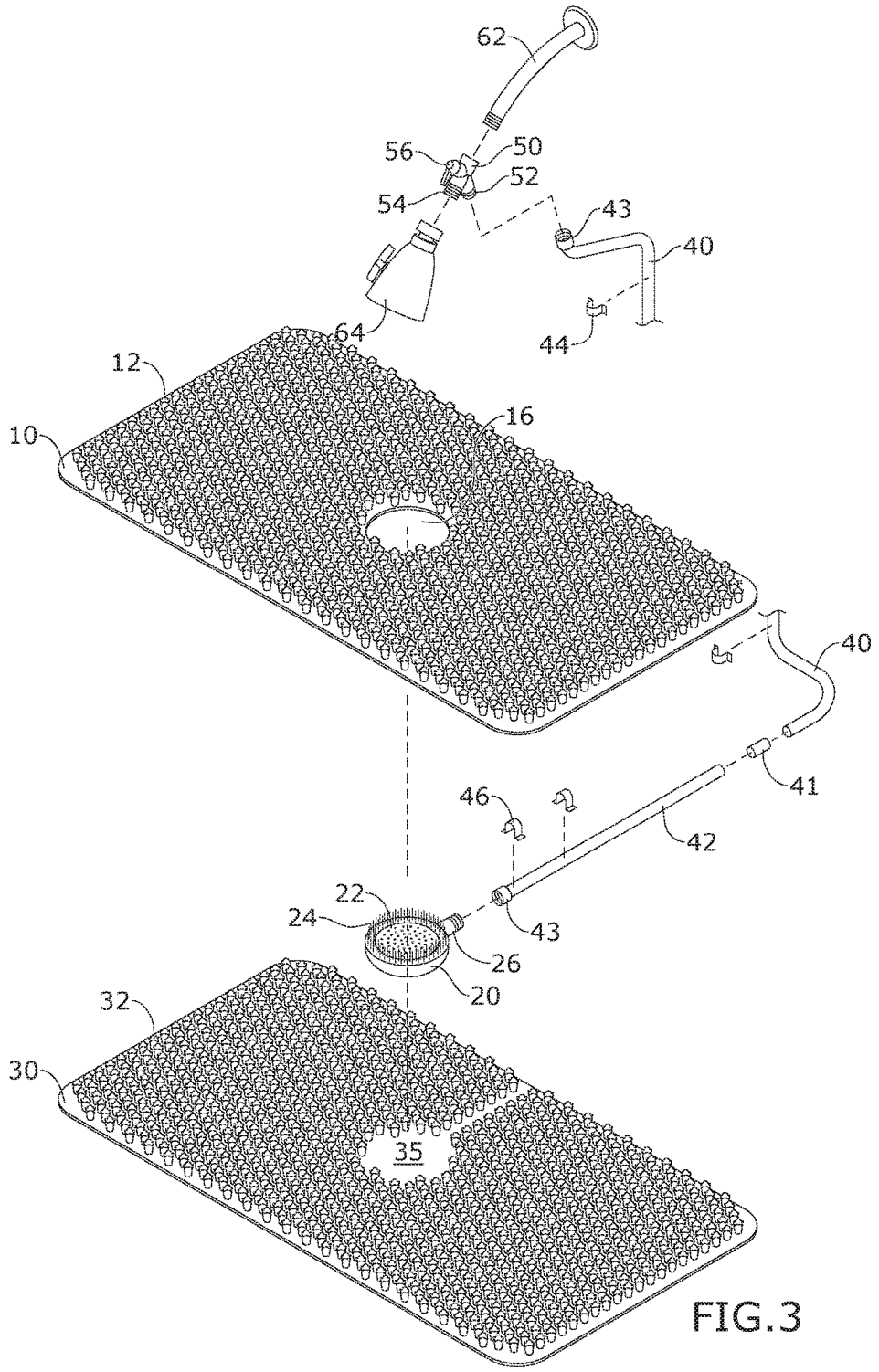
FIG. 3 is an exploded view of the shower mat with auxiliary shower spray head.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide a shower mat with an auxiliary shower head, in which the shower mat, provides a sure footing for the user and carries the auxiliary shower head so that user may clean their lower body and extremities.

As seen in reference to the drawings of FIGS. 1-4, the present invention includes a shower mat 10 that has an auxiliary shower spray head 20 carried therein. The spray head 20 is oriented to direct a vertical shower stream to direct water against the user's lower body and extremities to assist with cleaning and hygiene.

Tubing 40 interconnects the auxiliary shower spray head 20 to a stem 62 of a shower enclosure via tubing connector 43 to a diverter valve 50. The stem 62 selectively communicates a source of pressurized water to the diverter valve 50 via conventional water control valves of the shower enclosure. The diverter valve 50 includes a tubing connection 52, a primary head connection 54, and a diverter valve handle 56 that is operable to selectively regulate the flow of water through the diverter valve 50 to one or more of the primary shower head 64 and the auxiliary shower head 20.

In a first position, the diverter valve 50 may direct a full water flow to the primary shower head 64. In a second position, the diverter valve may direct a full water flow to the auxiliary shower spray head 20. In an intermediate position between the first position and the second position, the water flow may be directed to each of the primary shower head 64 and the auxiliary shower spray head 20.

The tubing 40 may include tubing connector segment 42 to communicate the water through the bath mat 10 to the auxiliary shower head 20. One or more clips 44 may be employed secure the tubing 40 within the shower enclosure.

Figure 4:
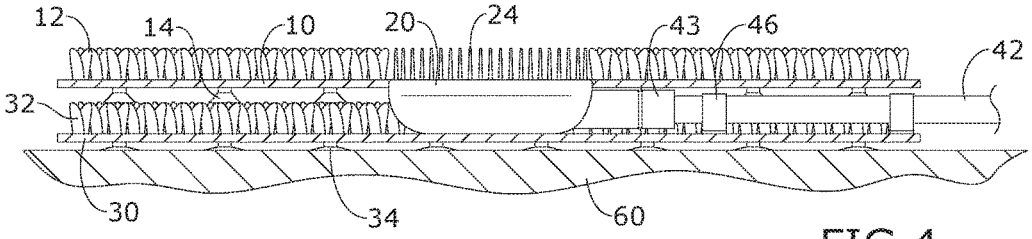
FIG. 4 is a section view of the shower mat with auxiliary shower spray head, taken along line 4-4 in FIG. 1, with plumbing components shown in full for clarity.
Figure 5:
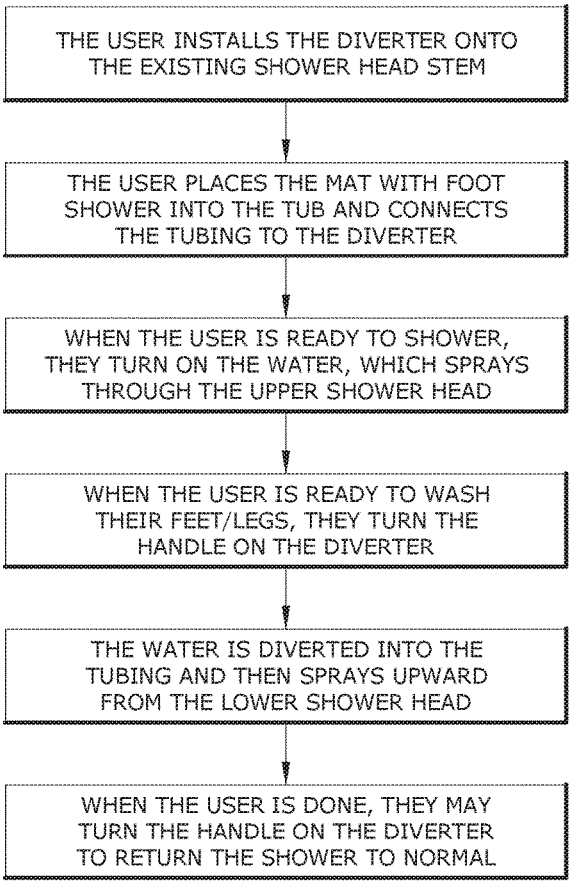
FIG. 5 is a flow chart of a typical use of the shower mat with auxiliary shower spray head.

As seen in reference to FIGS. 3 and 4, the shower mat may include an upper shower mat 10 and a lower shower mat 30. The upper shower mat 10 may include a plurality of resilient bristles 12 disposed in a spaced apart relation about a top surface of the upper shower mat 10. A cutout 16 is defined through the upper mat 10 and is dimensioned to receive an outer peripheral aspect of the auxiliary shower spray head 20. Preferably, the cutout 16 is defined in a central portion of the upper mat 10.

The lower shower mat 30 may also include a plurality of resilient bristles 32 defined in a spaced apart relation about a top surface of the lower mat 30. A cutout 35 is defined in the surface of the lower mat 30 and is dimensioned to receive the auxiliary shower spray head 20 and the tubing connector segment 42. One or more mat clips 46 may be employed to secure the tubing connector segment 42 to one or more of the upper mat 10, the lower mat 30, or a floor 60 of the shower enclosure.

The auxiliary shower head 20 has a front face defining a spray nozzle 22. A plurality of resilient bristles 24 may surround the spray nozzle 22. The resilient bristles 24 have a length to extend through the cutout 16 in the upper mat 10, preferably so that they terminate at a same elevation of the plurality of bristles in the upper mat 10. A connector 26 may be provided to interconnect the auxiliary shower spray head 20 with a connector 43 defined at a terminal end of the tubing connector segment 42.

As best seen in reference to FIG. 2, the upper shower mat 10 and the lower shower mat 30 may be joined by a stitch 35 that extends about an outer periphery of the upper and lower mats 10, 30.

To use the present invention, the user would install the diverter valve 50 to the stem 62. The mat's 10, 30 are installed within the shower enclosure 60 and the tubing 40 is interconnected between the diverter valve 50 and the auxiliary shower spray head 20 as described above. When the user is ready to shower, they turn on the water supply at the water control valves. With the diverter valve 50 in the first position, the water sprays from the primary shower head 62. When the user is ready to wash their feet and legs, they operate the control handle 56 of the diverter valve to the second position to divert water to emit through the spray nozzles 22 of the auxiliary spray head 20. The water is emitted vertically upward through the spray nozzles 22 so that the user may cleanse their lower extremities. If desired, the user may select an intermediate position and enjoy a full body shower via the primary spray head 62 and the auxiliary shower spray head 20.

A bathtub or shower enclosure 60 may thus be readily equipped to provide a foot, leg and lower body cleaning with a constant stream of water emitted vertically upward from the mat. This assures the feet, legs and lower body are thoroughly clean after a shower if this mat is used properly. The bathtub or shower foot, leg and body cleaning mat can be used with a cleaning agent followed by a water rinse from the mat. The bathtub or shower foot, leg and body cleaning mat can be placed directly on the floor of a bathtub or shower so that a person may stand upright or in a chair for an elderly or disability person. The present invention thus provides a constant stream of water to the shower mat for the proper cleaning of people of all ages, disability at home and in facilities (hospitals, rehab centers, etc.). The present invention may also be utilized without the primary spray head 60 to provide a vertically oriented spray and mat.

It should be understood, of course, that the foregoing relates to exemplary embodiments of the invention and that modifications may be made without departing from the spirit and scope of the invention as set forth in the following claims.

What is claimed is:

1. A shower mat with auxiliary shower spray head, comprising:

a first mat formed of a resilient material having a first cutout defined in the surface thereof;

a second mat formed of a resilient material having a second cutout defined in a surface thereof;

an auxiliary shower spray head, having a body, an inlet adapted to receive a source of pressurized water, and a spray nozzle face in communication with the inlet, wherein the body is adapted to be received in the second cutout and the spray nozzle face is adapted to be received in the first cutout such that the spray nozzle face is oriented to direct a spray of water vertically upwardly.

2. The shower mat of claim 1, further comprising:

a plurality of resilient bristles defined in a spaced apart relation about a peripheral edge of the spray nozzle face.

3. The shower mat of claim 1, further comprising:

a plurality of resilient bristles defined in a spaced apart relation about a top surface of the first mat.

4. The shower mat of claim 3, further comprising:

a second plurality of resilient bristles defined in a spaced apart relation about a top surface of the second mat.

5. The shower mat of claim 1, further comprising:

a diverter valve connectable between a stem of a shower enclosure and a primary shower head of the shower enclosure, wherein the diverter valve is operable between a first position directing a flow of pressurized water to the primary shower head and a second position directing the flow of pressurized water to the auxiliary shower spray head.

6. The shower mat of claim 5, wherein the diverter valve directs a proportion of the flow between the primary shower head and the auxiliary shower when operated at an intermediate position between the first position and the second position.

7. The shower mat of claim 6, further comprising:

an elongate tube having a first end and a second end, wherein the first end is adapted to connect to the diverter valve and the second end is adapted to connect to the inlet.

8. The shower mat of claim 7, wherein the elongate tube further comprises:

a tubing connector segment interposed between the inlet and the second end of the tubing.

9. The shower mat of claim 8, further comprising;

one or more clips to secure the tubing to the shower enclosure.

10. The shower mat of claim 1, further comprising:

a stitch to join the first mat to the second mat.

11. The shower mat of claim 10, herein the stitch extends around an outer periphery of the first mat and the second mat.

* * * * *